US009581054B2

(12) United States Patent
Bayrakdar et al.

(10) Patent No.: US 9,581,054 B2
(45) Date of Patent: Feb. 28, 2017

(54) CAMSHAFT ADJUSTER WITH A ROLLED CONNECTION

(71) Applicant: Schaeffler Technologies GmbH & Co. KG, Herzogenaurach (DE)

(72) Inventors: Ali Bayrakdar, Roethenbach/Pegnitz (DE); Andreas Schulte, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/432,110

(22) PCT Filed: Jul. 23, 2013

(86) PCT No.: PCT/DE2013/200070

§ 371 (c)(1),
(2) Date: Mar. 27, 2015

(87) PCT Pub. No.: WO2014/056489

PCT Pub. Date: Apr. 17, 2014

(65) Prior Publication Data

US 2015/0240672 A1 Aug. 27, 2015

(30) Foreign Application Priority Data

Oct. 10, 2012 (DE) ..... 10 2012 218 405

(51) Int. Cl.
*F01L 1/46* (2006.01)
*F01L 1/344* (2006.01)

(52) U.S. Cl.
CPC ... *F01L 1/3442* (2013.01); *F01L 2001/34479* (2013.01)

(58) Field of Classification Search
CPC ..... Y10T 137/8667; F01L 2001/3445; F01L 2001/3443; F01L 2001/34433; F01L 2001/34426; F01L 2001/34446; F01L 1/3442; F01L 2001/34479
USPC ..... 123/90.15, 90.17
See application file for complete search history.

(56) References Cited

U.S. PATENT DOCUMENTS

| | | | | |
|---|---|---|---|---|
| 5,566,651 | A | 10/1996 | Strauss et al. | |
| 6,276,321 | B1 | 8/2001 | Lichti et al. | |
| 6,418,893 | B1 | 7/2002 | Auchter et al. | |
| 6,964,250 | B2 | 11/2005 | Wierl et al. | |
| 7,284,516 | B2 | 10/2007 | Wierl et al. | |
| 8,910,603 | B2 | 12/2014 | Bayrakdar | |
| 8,931,447 | B2 | 1/2015 | Schulte et al. | |
| 2005/0011481 | A1* | 1/2005 | Naumann | F01L 1/022 123/90.17 |

(Continued)

FOREIGN PATENT DOCUMENTS

| | | | |
|---|---|---|---|
| CN | 1629453 | A | 6/2005 |
| DE | 4218082 | A1 | 12/1993 |

(Continued)

*Primary Examiner* — Jorge Leon, Jr.
(74) *Attorney, Agent, or Firm* — Davidson, Davidson & Kappel, LLC

(57) ABSTRACT

A hydraulic camshaft adjuster (1) including a stator (2) and a rotor (3) arranged such that it can rotate relative thereto, the stator (2) being connected to at least one separate cover (7) that seals a cavity (11) located between the rotor (3) and the stator (2). In the region of the cover (7), the material of the stator (2) at least partially encompassing said cover (7) is formed without machining.

15 Claims, 2 Drawing Sheets

(56) References Cited

U.S. PATENT DOCUMENTS

| | | | | |
|---|---|---|---|---|
| 2012/0097122 | A1* | 4/2012 | Lichti | F01L 1/3442 123/90.15 |
| 2013/0055979 | A1 | 3/2013 | Bayrakdar et al. | |
| 2013/0087112 | A1 | 4/2013 | Schulte et al. | |
| 2013/0312677 | A1 | 11/2013 | Bayrakdar | |

FOREIGN PATENT DOCUMENTS

| | | | | |
|---|---|---|---|---|
| DE | 102 21 734 | | 11/2003 | |
| DE | 10358888 | A1 | 7/2005 | |
| DE | 10359068 | A1 | 7/2005 | |
| DE | 10 2008 029692 | | 1/2010 | |
| DE | 102008029692 | A1 * | 1/2010 | F01L 1/053 |
| DE | 102008032028 | A1 | 1/2010 | |
| DE | 10 2009 037 976 | A1 | 2/2011 | |
| DE | 102009037976 | A1 | 2/2011 | |
| DE | 10 2010 012 482 | A1 | 9/2011 | |
| DE | 102010012482 | A1 | 9/2011 | |
| DE | 10 2010 024 596 | A1 | 12/2011 | |
| DE | 102010024596 | A1 | 12/2011 | |
| DE | 102011003556 | A1 | 8/2012 | |
| DE | 102011003556 | A1 | 8/2012 | |

* cited by examiner

CAMSHAFT ADJUSTER WITH A ROLLED CONNECTION

The present invention relates to a hydraulic camshaft adjuster having stator and a rotor situated so that it is rotatable in relation thereto, the stator being connected to at least one separate cover, which seals a cavity situated between the rotor and the stator.

BACKGROUND

Camshaft adjusters, in particular hydraulic camshaft adjusters, are already known from the prior art from U.S. Pat. No. 6,276,321 B1, for example.

Such devices for variable adjustment of the control times of gas exchange valves are used in modern internal combustion engines to be able to variably set the phase ratio between the crankshaft and the camshaft in a defined angle range between a maximum "advance" position and a maximum "retard" position. For this purpose, the camshaft adjuster is integrated into a drive train, via which the torque is transferred from the crankshaft to the camshaft. This drive train may include a traction means such as a belt drive or a chain drive. A gear drive may also be used in this regard.

Details of how camshafts are modified in comparison with a crankshaft of an internal combustion engine are to be found in the publications DE 10 2010 012 482 A1 and DE 2011 003 556 A1, for example. A device for controlling and/or influencing valve control times of an internal combustion engine is also known from DE 10 2010 024 596 A1 and DE 10 2009 037 976 A1.

The details described in these publications also form the basis for the refinement presented here and will not be discussed further here but should be considered as integrated therein.

Previously, the cavity between the rotor and the stator, which is to be filled with a hydraulic fluid, such as a liquid, namely oil, has been sealed by at least one cover with respect to the outside. A screw connection is usually used here.

However, such a screw connection approach has the disadvantage that it requires many individual parts. This makes the assembly difficult. Furthermore, the possibility of leakage cannot always be ruled out reliably. Furthermore, such a screw connection approach is relatively heavy, so that heavy camshaft adjusters must be used. This is disadvantageous for the consumption of the motor vehicles, which use such camshaft adjusters on internal combustion engines. The precision of the adjustment angle between the rotor and the stator is also not adequately high in some application cases. Unfortunately, ease of dismantling and/or misuse cannot be ruled out in all application cases.

SUMMARY OF THE INVENTION

It is an object of the present invention to eliminate these disadvantages, to omit screw connections and nevertheless make available a long-lived as well as a permanently well-functioning assembly subunit.

The present invention provides that in the case of a generic hydraulic camshaft adjuster, the material of the stator, encompassing the cover at least partially, is formed without machining in the area of the cover.

Thus a secure connection is created which is designed to withstand higher pressure loads at minimized costs nevertheless. A simple design of the camshaft adjuster is just as possible as the provision of a larger adjustment angle. Misuse is ensured due to the secure connection making dismantling difficult. Leakage may also be reduced substantially. External leakage is even completely ruled out. Fewer individual parts must be used and screws and nuts may be omitted in particular.

It is advantageous if there is a force-locked and/or form-fitting connection between the stator and the cover. This makes it possible to simplify production and ensure a fail-safe cooperation of the individual parts.

It is also advantageous if the connection forms an undercut in which the cover is retained with a seal. This makes it possible to withstand particularly high pressures.

It has been found to be almost optimal if the cover is secured on the stator by a rolled connection.

It is advantageous here if the rolled connection is formed over the entire circumference of the cover or if it is formed on only some sections. If a flow of material is induced over 360°, then the seal is formed over the entire circumference and is particularly resilient.

If the material of the stator is forced and/or flows into a cavity, the cavity being between the stator and a chamfer situated on the side of the cover facing away from the cavity and extending preferably over the circumference, then a particularly efficient connection of the two components is ensured. It is advantageous here if the cavity is completely filled by the material of the stator.

An advantageous exemplary embodiment is also characterized in that the cover is mounted on at least one axial end of the cavity accommodating a hydraulic fluid such as oil, preferably on the face side of the stator, and the other axial end of the cavity is situated above an integral bottom of the stator, which is then designed in the form of a cup. Furthermore, another exemplary embodiment is characterized in that a first cover, which is separate from the stator, is attached to at least one first axial end of the cavity, preferably to a first face side of the stator, which is then in the form of a bushing or sleeve, and a second cover is attached to a second axial end of the cavity, preferably the second face side of the stator. The two covers may be connected to the stator via exterior rolled connections. In the first of the aforementioned two exemplary embodiments, the same parts may be increasingly resorted to, while the number of individual parts may be reduced in the second of the aforementioned two exemplary embodiments.

It is also particularly effective if the cover is designed as a sealing cover and/or as a locking cover having a locking contour. The cover may then be connected to the stator via a rolled connection in a form-fitting manner after insertion of the interior structure of the adjuster, with the stator in a predefined location, thereby causing a flow of material over the cover by 360°.

It is also advantageous if the first cover is designed as a sealing cover and the second cover, which is preferably situated on the side of a gearwheel engaging on the stator, is designed as a locking cover, which seals the cavity. This results in a particularly secure connection having good force distribution properties.

It is also advantageous if the stator and/or the cover is/are made of metal such as sintered metal because then a particularly stable approach is achievable.

If, in addition to the rolled connection, form-fitting elements take effect such as protrusions engaging in recesses, then a twist-proof security is achievable in a particularly effective manner and microgliding may also be prevented. The form-fitting elements may be aligned in the axial direction and/or in the radial direction just like additional force-locking elements. Such force-locking elements may be formed by roughened areas, application of adhesive or addition of solder.

BRIEF DESCRIPTION OF THE DRAWINGS

The present invention is also explained in greater detail below with the aid of drawings in which two exemplary embodiments are shown.

DETAILED DESCRIPTION

Figure 3:
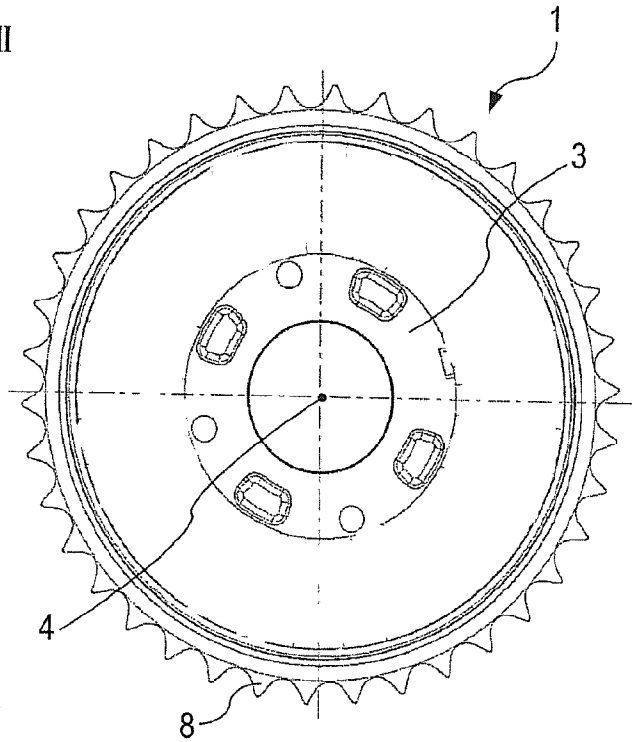
FIG. 3 shows a view from the front of the camshaft adjuster from FIG. 1.

These figures are only of a schematic nature and only promote an understanding of the present invention. The same elements are provided with the same reference numerals.

Figure 1:
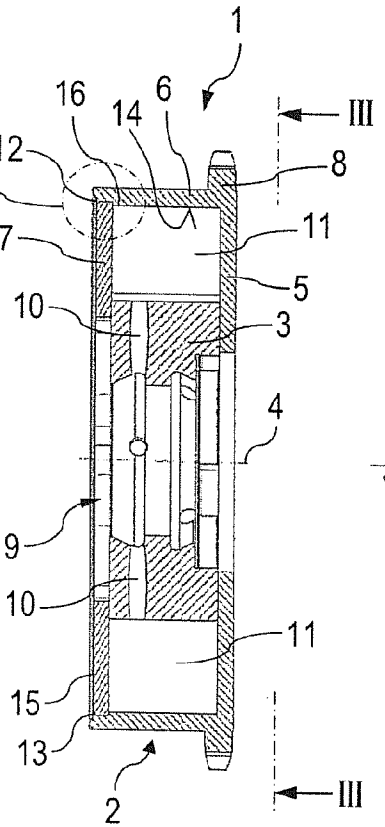
FIG. 1 shows a longitudinal sectional diagram through a first specific embodiment of a hydraulic camshaft adjuster according to the present invention having only one cover.

FIG. 1 shows a first specific embodiment of a hydraulic camshaft adjuster 1 according to the present invention. The hydraulic camshaft adjuster has a stator 2, which is designed in the form of a cup in the exemplary embodiment shown here.

A rotor 3 is accommodated in the interior of stator 2. Rotor 3 is rotatably mounted in relation to stator 2 about a common longitudinal axis 4, which functions as the axis of rotation. Stator 2 has a bottom 5 and a longitudinal wall 6 which extends completely around longitudinal axis 4 and is closed on the circumference. Bottom 5 is an integral part of longitudinal wall 6. A cover 7 is provided on the side opposite bottom 5.

An integral gearwheel 8 is also formed on stator 2 on the side of bottom 5. Gearwheel 8 is designed for coming into force-transferring contact with a traction means, such as a chain or a belt for transferring force from a crankshaft to stator 2.

Rotor 3 has an insert area 9 for insertion of a central valve. Two fluid lines 10 are recognizable in the sectional view in FIG. 1, although multiple fluid lines 10 are used. Different cells of a cavity 11 situated between stator 2 and rotor 3 may be supplied with hydraulic fluid (hydraulic oil) in a targeted or directed manner.

A connection 12 is formed between stator 2 and cover 7 on the side of cover 7 facing away from bottom 5. This connection 12 is discernible in a particularly clear manner in FIG. 2. Connection 12 is created by a rolling operation in which material of stator 2 has been formed/compressed around an edge of cover 7. In the corresponding formation without machining, the material flows pressure-induced behind cover 7.

Cover 7 is inserted fittingly or with an excess of fit into the cavity between a chamfer 13 and an inner wall 14 of stator 2. Cover 7 acts as a sealing cover.

The material of stator 2 situated adjacent to cover 7, in particular adjacent to chamfer 13 of cover 7 and on the end of stator 2 remote from the bottom in longitudinal wall 6 of stator 2, has been forced into the aforementioned cavity between cover 7 and stator 2 by a rolling operation/formation without machining. The material of stator 2 has flowed into this cavity and completely fills the cavity.

The end of stator 2 remote from bottom 5 protrudes beyond cover 7 (protruding axially). A recess 15 is formed there and may also be referred to as a groove or channel.

FIG. 3 shows the hydraulic camshaft adjuster 1 having a central valve which is not yet inserted into insert area 9.

Figure 2:
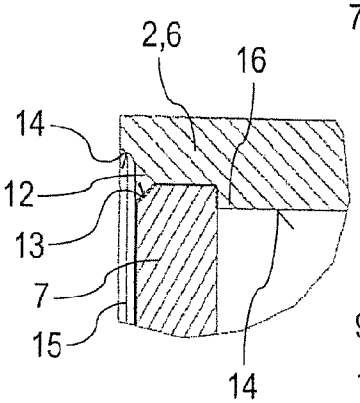
FIG. 2 shows an enlargement of the connecting area between the cover and the stator from FIG. 1.
Figure 6:
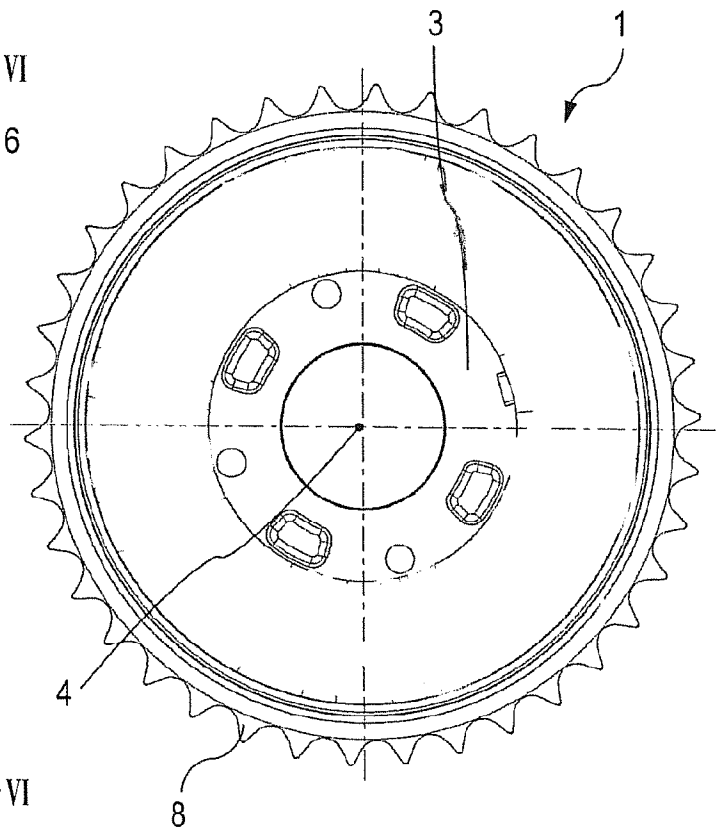
FIG. 6 shows a side view of the hydraulic camshaft adjuster from FIG. 4.
Figure 4:
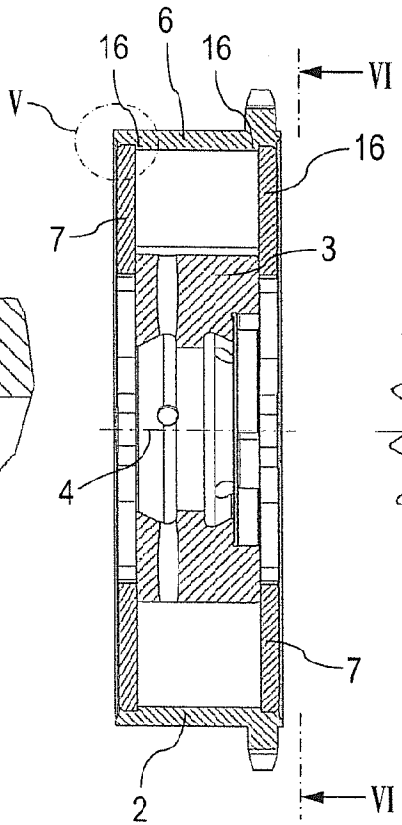
FIG. 4 shows a longitudinal section through a second specific embodiment of a hydraulic camshaft adjuster having two covers, each being connected to the stator via one rolled connection.
Figure 5:
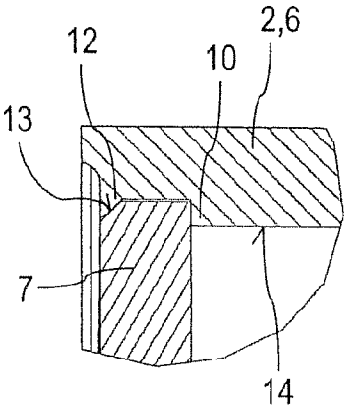
FIG. 5 shows an enlargement of the connecting area between a cover at a distance from the gearwheel and the stator on the camshaft adjuster from FIG. 4.

FIGS. 4 through 6 illustrate an exemplary embodiment, which has been modified in comparison with FIGS. 1 through 3. Whereas stator 2 is designed in the form of a cup in the exemplary embodiment illustrated in FIGS. 1 through 3, stator 2 in the second exemplary embodiment is designed in the form of a sleeve or bushing. It is designed in the manner of a hollow cylinder having a circular interior and exterior contour, circumferential grooves or channels for accommodating cover 7 being provided on the inner circumference at the ends.

Stator 2 thus has no bottom 5 but instead also has a cover 7 in this location but it is inserted into stator 2 as a locking cover having a locking contour, thereby forming a seal. As is also the case with cover 7 (sealing cover), which (only) forms a seal at a distance from the gearwheel, this second cover 7 (locking cover) is also in contact with a shoulder 16 of stator 2, the shoulder being formed by the corresponding groove or channel.

Just as left cover 7 is attached to stator 2 via a rolled connection, right cover 7 is also attached to stator 2 via a rolled connection. The corresponding rolled connections extend around longitudinal axis 4 by 360°.

LIST OF REFERENCE NUMERALS

1 hydraulic camshaft adjuster
2 stator
3 rotor
4 longitudinal axis
5 bottom
6 longitudinal wall
7 cover
8 gearwheel
9 insert area
10 fluid line
11 cavity
12 connection
13 chamfer
14 interior wall
15 recess
16 shoulder

What is claimed is:

1. A hydraulic camshaft adjuster comprising:

a stator;

a rotor rotatably situated in relation to the stator; and at least one separate cover, the stator being connected to the cover, the cover sealing a cavity situated between the rotor and the stator, a material of the stator being formed without machining in the area of the cover and encompassing the cover at least partially; wherein a force-locking or form-fitting connection is provided between the stator and the cover, the cover having two sides and an edge between the two sides, the stator contacting the cover on the two sides to create the force-locking or form-fitting connection.

2. The hydraulic camshaft adjuster as recited in claim 1 wherein the connection forms an undercut, the cover being retained in the undercut with a seal.

3. The hydraulic camshaft adjuster as recited in claim 1 wherein the cover is secured on the stator via a rolled connection.

4. The hydraulic camshaft adjuster as recited in claim 3 wherein in addition to the rolled connection, the connection includes form-fitting elements engage in recesses.

5. The hydraulic camshaft adjuster as recited in claim 3 wherein the form-fitting elements include protrusions.

6. The hydraulic camshaft adjuster as recited in claim 1 wherein the material of the stator has been forced into or has flowed into a cavity between a chamfer and the stator.

7. The hydraulic camshaft adjuster as recited in claim 1 wherein the cover is mounted on at least one axial end of the cavity accommodating a hydraulic fluid and the other axial end of the cavity is sealed via an integral bottom of the cup-shaped stator, or the cover separate from the stator is mounted on at least a first axial end of the cavity, and a second cover is mounted on a second axial end of the cavity.

8. The hydraulic camshaft adjuster as recited in claim 7 wherein the one axial end of the cavity is a face-side end of the stator.

9. The hydraulic camshaft adjuster as recited in claim 7 wherein the front end is a first face-side end of stator, the stator being the bushing- or sleeve-shaped stator.

10. The hydraulic camshaft adjuster as recited in claim 7 wherein the second axial end of the cavity is a second face-side end of the stator.

11. The hydraulic camshaft adjuster as recited in claim 1 wherein the cover is designed as a sealing cover or as a locking cover having a locking contour.

12. The hydraulic camshaft adjuster as recited in claim 11 wherein the cover is designed as the sealing cover while the second cover being designed as a locking cover sealing the cavity.

13. The hydraulic camshaft adjuster as recited in claim 12 wherein the second cover is situated on the side of a gearwheel engaging on the stator.

14. The hydraulic camshaft adjuster as recited in claim 1 wherein the stator or the cover is made of metal.

15. The hydraulic camshaft adjuster as recited in claim 14 wherein the metal is sintered metal.

* * * * *